US009192215B2

(12) United States Patent
Ma

(10) Patent No.: US 9,192,215 B2
(45) Date of Patent: Nov. 24, 2015

(54) QUICK ASSEMBLY METHODS AND COMPONENTS FOR SHADE STRUCTURES

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 71 days.

(21) Appl. No.: 13/783,958

(22) Filed: Mar. 4, 2013

(65) Prior Publication Data

US 2014/0246062 A1 Sep. 4, 2014

(51) Int. Cl.
*A45B 25/06* (2006.01)
*A45B 25/10* (2006.01)
*A45B 25/00* (2006.01)

(52) U.S. Cl.
CPC ..... *A45B 25/10* (2013.01); *A45B 25/00* (2013.01); *A45B 25/06* (2013.01); *Y10T 29/40* (2015.01)

(58) Field of Classification Search
CPC ..... A45B 25/06; A45B 25/10
USPC ..... 135/28, 29, 30, 135, 147
See application file for complete search history.

(56) References Cited

U.S. PATENT DOCUMENTS

| | | | | |
|---|---|---|---|---|
| 331,231 | A | 11/1885 | Folger | |
| 501,089 | A | 7/1893 | Lichtenstein | |
| 620,815 | A | 3/1899 | Warren | |
| 750,178 | A | 1/1904 | Fesenfeld | |
| 770,704 | A | 9/1904 | Vogel | |
| 847,805 | A | 3/1907 | McAvoy | |
| 878,270 | A | 2/1908 | Blake et al. | |
| 880,534 | A | 3/1908 | Hoyt | |
| 897,026 | A | 8/1908 | Seitzinger | |
| 928,169 | A | 7/1909 | Bardon | |
| 941,952 | A | 11/1909 | Riehl | |
| 947,790 | A | 2/1910 | Carter | |
| 959,127 | A | 5/1910 | Edwards | |
| 1,001,076 | A | 8/1911 | Redford | |
| 1,022,944 | A | 4/1912 | Hodinger | |
| 1,078,069 | A * | 11/1913 | Simons | 135/30 |
| 1,107,415 | A | 8/1914 | Drohan | |
| 1,264,075 | A | 4/1918 | Hout | |
| 1,469,495 | A | 10/1923 | Bunker | |

(Continued)

FOREIGN PATENT DOCUMENTS

| | | |
|---|---|---|
| CA | 1269018 | 5/1990 |
| DE | 1152226 | 8/1963 |

(Continued)

OTHER PUBLICATIONS

U.S. Appl. No. 13/787,601 and its prosecution history, Mar. 6, 2013, Ma.

(Continued)

*Primary Examiner* — David R Dunn
*Assistant Examiner* — Danielle Jackson
(74) *Attorney, Agent, or Firm* — Knobbe Martens Olson & Bear, LLP

(57) ABSTRACT

A quick connect system is provided for a shade structure. The system includes a hub and a structural member. The hub has a top surface, a plurality of side walls forming a slot therebetween, and a displaceable retention device having a free end disposed at an elevation below the top surface. The displaceable retention device is moveable laterally away from the slot. The structural member has an end configured to swing in the slot. The end has a laterally extending rotation device. The rotation device extends laterally beyond the free end of the displaceable retention device when the end is disposed in the slot.

24 Claims, 17 Drawing Sheets

(56) References Cited

U.S. PATENT DOCUMENTS

| | | | |
|---|---|---|---|
| 1,808,610 | A | 6/1931 | Roy |
| 2,101,510 | A | 12/1937 | Rathbun |
| 2,207,043 | A | 7/1940 | Weiss et al. |
| 2,321,495 | A | 6/1943 | Levin |
| 2,336,116 | A | 12/1943 | Morando |
| 2,385,575 | A | 9/1945 | Isler |
| 2,469,637 | A | 5/1949 | Evans et al. |
| 2,635,616 | A | 4/1953 | Haydu |
| 2,762,383 | A | 9/1956 | Wittman |
| 2,796,073 | A | 6/1957 | Wittman |
| 2,860,647 | A | 11/1958 | Negri |
| 2,914,154 | A | 11/1959 | Russell |
| 3,177,882 | A | 4/1965 | Vincent |
| 3,330,582 | A | 7/1967 | Morris |
| 3,424,180 | A | 1/1969 | Andolfi |
| 3,462,179 | A | 8/1969 | Hinkle |
| 3,557,809 | A | 1/1971 | Vazquez et al. |
| 3,643,673 | A | 2/1972 | Weber |
| 3,704,479 | A | 12/1972 | Whitaker |
| 4,201,237 | A | 5/1980 | Watts et al. |
| 4,368,749 | A | 1/1983 | Lindler et al. |
| 4,369,000 | A | 1/1983 | Egnew |
| 4,627,210 | A | 12/1986 | Beaulieu |
| 4,673,308 | A | 6/1987 | Reilly |
| 4,750,509 | A | 6/1988 | Kim |
| 4,941,499 | A | 7/1990 | Pelsue et al. |
| D320,111 | S | 9/1991 | Ma |
| 5,056,291 | A | 10/1991 | Leung |
| 5,069,572 | A | 12/1991 | Niksic |
| 5,085,239 | A | 2/1992 | Chin-Hung et al. |
| 5,188,137 | A | 2/1993 | Simonelli |
| 5,193,566 | A | 3/1993 | Chen |
| 5,328,286 | A | 7/1994 | Lee |
| 5,433,233 | A | 7/1995 | Shiran et al. |
| 5,445,471 | A | 8/1995 | Wexler et al. |
| 5,738,129 | A | 4/1998 | Vogt |
| 5,740,824 | A | 4/1998 | Tang |
| 5,797,613 | A | 8/1998 | Busby |
| 5,797,695 | A | 8/1998 | Prusmack |
| 5,911,233 | A | 6/1999 | Wu |
| 6,076,540 | A | 6/2000 | You |
| 6,095,169 | A | 8/2000 | Lin et al. |
| 6,311,706 | B1 | 11/2001 | Sato |
| 6,314,976 | B1 | 11/2001 | Clarke |
| 6,332,657 | B1 | 12/2001 | Fischer |
| 6,345,637 | B1 | 2/2002 | Ko |
| 6,354,316 | B1 | 3/2002 | Chen |
| 6,374,840 | B1 | 4/2002 | Ma |
| 6,386,215 | B1 | 5/2002 | Chang |
| 6,397,867 | B2 | 6/2002 | You |
| 6,604,844 | B2 | 8/2003 | Hussey |
| 6,643,889 | B1 | 11/2003 | Kotlarski |
| 6,701,946 | B2 | 3/2004 | You |
| 6,705,335 | B2 | 3/2004 | You |
| 6,758,228 | B1 | 7/2004 | You |
| 6,814,093 | B2 | 11/2004 | You |
| 7,178,535 | B2 | 2/2007 | Eder |
| 7,464,503 | B2 | 12/2008 | Hoberman |
| 7,481,235 | B2 | 1/2009 | Prusmack |
| 7,574,777 | B1 | 8/2009 | Fuller et al. |
| 7,703,464 | B2 | 4/2010 | Ma |
| 7,891,367 | B2 | 2/2011 | Ma |
| 8,061,375 | B2 | 11/2011 | Ma |
| 8,069,872 | B2 | 12/2011 | Bae |
| 8,082,935 | B2 | 12/2011 | Ma |
| 8,166,986 | B2 | 5/2012 | Ma |
| 8,485,208 | B2 | 7/2013 | Seo |
| 2004/0123891 | A1 | 7/2004 | Ma |
| 2005/0115599 | A1 | 6/2005 | You |
| 2006/0124160 | A1 | 6/2006 | Lee |
| 2007/0172310 | A1 | 7/2007 | Yang et al. |
| 2009/0126769 | A1 | 5/2009 | Hoogendoorn |
| 2009/0260664 | A1 | 10/2009 | Ma |
| 2011/0017249 | A1* | 1/2011 | Ma ..... 135/39 |
| 2012/0318316 | A1* | 12/2012 | Choi et al. ..... 135/135 |
| 2013/0276843 | A1 | 10/2013 | Ma |

FOREIGN PATENT DOCUMENTS

| | | |
|---|---|---|
| EP | 0202769 | 12/1989 |
| FR | 855628 | 5/1940 |
| FR | 002650491 | 2/1991 |
| FR | 2857835 | 1/2005 |
| GB | 2113543 | 8/1983 |
| JP | 61131921 | 8/1986 |
| KR | 100851744 | 8/2008 |
| WO | WO 2005/023042 | 3/2005 |

OTHER PUBLICATIONS

U.S. Appl. No. 14/189,822 and its prosecution history, Feb. 25, 2014, Ma.

EPO Extended Search Report dated Apr. 5, 2011 for European European Patent No. 09252140.0, filed Sep. 7, 2009.

Treasure Garden, 2010 Products Catalog, pp. 20 and 60.

Extended European Search Report issued in EP Application No. 14157685, dated Jul. 7, 2014, in 8 pages.

Extended European Search Report issued in EP Application No. 14158057, dated Jul. 7, 2014, in 7 pages.

* cited by examiner

QUICK ASSEMBLY METHODS AND COMPONENTS FOR SHADE STRUCTURES

BACKGROUND OF THE INVENTIONS

1. Field of the Invention

This application relates to apparatuses and methods that facilitate efficient assembly of ribs and hubs of umbrellas and other structures with a plurality of arms that extend from a central hub member.

2. Description of the Related Art

Larger umbrellas, such as market umbrellas, generally include a frame-like structure that is used to support and distribute the weight of an upper portion of the umbrella as well as to enable the umbrella to be opened and closed as desired by the user. The frame-like structure of such umbrellas can take various forms, but often includes one more hubs connected with a plurality of movable structural members.

Past methods of assembly of umbrella hubs and ribs was labor intensive. The process involved inserting a pin through an end portion of a set of ribs, positioning all of the rib ends in a lower portion of a hub, and then placing an upper portion of the hub over the ribs so positioned. Finally, screws were used to attach an upper portion of the hub to the lower portion. While achieving the result of assembling the hub and ribs, this process is tedious and sometimes requires rework, for example if the rib ends become misaligned before the upper hub portion is attached to the lower hub portion.

SUMMARY OF THE INVENTIONS

It would be beneficial to provide structures that enable quicker and less labor intensive assembly of umbrella assemblies, e.g., rib and hub assemblies. An aspect of at least one of the embodiments disclosed herein is the realization that the connection devices used in the assembly of shade structures, such as pavilions and outdoor umbrellas, can be improved to provide a more secure, quicker, and more reliable connection. Such devices can use fewer parts and be easier to manufacture than those devices of the prior art. Such improved connections can be particularly advantageous for large shade structures.

According to another aspect of at least one embodiment disclosed herein is the realization that prior art umbrella hubs include an excessive amount of individual components. For example, individual pins are often individually placed into a portion of the hub before portions of the hub are carefully assembled. This tedious manufacturing can be costly and frustrating. Therefore, embodiments disclosed herein seek to remedy this deficiency by providing a hub assembly that uses a reduced number of parts. Accordingly, the time and cost required for manufacturing the hub can be greatly decreased.

Another aspect of at least one of the embodiments disclosed herein is the realization that while some devices to expedite assembly have been suggested, such devices have been inadequate, for example lacking the ability to bear a full range of operational loads, which can be much higher than the weight of the components of the shade structure, particularly in windy conditions. As such, the members of a frame of a shade structure should be quickly, securely, and firmly interconnected so that the frame can properly support not only the weight of the various structural members and the canopy, but also the stresses and other forces that are common or possible during the use of such structures.

In one aspect, an umbrella assembly is provided that comprises an umbrella pole, an umbrella structural member, and a hub. The umbrella structural member has a first end and a second end. The first end is disposed away from the umbrella pole when the umbrella assembly is in an open configuration. The second end of the umbrella structural member has a pivoting member extending transverse to a longitudinal axis of the umbrella structural member. The hub includes a body having a central portion disposed about the umbrella pole. The hub also has a top surface and a bottom surface extending between the central portion and an outer periphery of the hub. The hub also has an engagement section adjacent to the outer periphery, which has the second end of the umbrella structural member disposed therein. The hub also has a retention mechanism disposed within the engagement section. The retention mechanism has a channel, a deflectable member, and a base surface. The channel extends from an opening at the top surface toward the bottom surface of the hub. The deflectable retention device is disposed along the channel and has a free end disposed away from the top surface of the body. The free end has a cap surface. The base surface is disposed within the body of the hub. The pivoting member is retained between the base surface and the cap surface.

In another aspect, a quick connect system is provided for a shade structure. The system includes a hub and a structural member. The hub has a top surface, a plurality of side walls forming a slot therebetween, and a displaceable retention device having a free end disposed at an elevation below the top surface. The displaceable retention device is moveable laterally away from the slot. The structural member has an end configured to swing in the slot. The end has a laterally extending rotation device, e.g. a pin. The rotation device extends laterally beyond the free end of the displaceable retention device when the end of the structural member is disposed in the slot.

In another aspect, an umbrella hub is provided that includes a central portion and a body. The central portion is configured to receive to an umbrella pole. The body has a top surface and a bottom surface extending between the central portion and an outer periphery of the hub. An outer portion disposed adjacent to the outer periphery is configured to receive an end portion of an umbrella structural member. The hub also includes a retention mechanism disposed within the outer portion of the body. The retention mechanism includes a channel and a moveable retention device. The channel extends from an opening at the top surface toward the bottom surface. The moveable retention device is disposed between the opening and the bottom surface. A first configuration of the moveable retention device permits an umbrella structural member to be moved from the opening of the channel to a retained position. A second configuration the moveable retention device prevents the umbrella structural member from being withdrawn from the retention mechanism.

Various embodiments can broadly encompass an umbrella hub with an assembly channel that extends vertically, at least in part, such that a portion of the assembly process involves placing an end of a rib or a strut or other shade structure member into the assembly channel from a hub top surface. If the assembly process is done in an upright position, the end of the rib will be placed in the assembly channel from above.

In other broad aspects, a downward movement of a pin can actuate a retention device from a blocking configuration to an assembly configuration. The retention device can return to a blocking configuration by releasing stored strain energy. These configurations may provide for a simple downward movement to actuate a retention mechanism out of the blocking configuration and to permit the retention mechanism to return to the blocking configuration. As used herein, downward can refer to vertically from a higher elevation to a lower elevation and also can mean generally away from a top surface of a hub toward a bottom surface of the hub regardless of the orientation of the hub.

In other aspects, a retention device is provided in an umbrella hub and rib combination. In the combination, a projecting member (e.g., a pin) and a hanging surface are provided. One of the projecting member and the hanging or retaining surface is configured to be displaced to permit relative movement among the combination. For example, the pin can be spring loaded to be displaced into a hollow body while the hanging or retaining surface is static. In other embodiments, the hanging or retaining surface can be spring loaded to be displaced into a hollow body while the projecting member is static. Advantageous manners of spring loading a hanging or retaining surface include providing a ramped surface extending upwardly from the surface. The ramped surface permits the surface to displace out of the way as the projecting member moves progressively closer to the elevation of the surface. Preferably the ramped surface loads a spring, e.g., by inducing elastic strain in a structure. In some embodiments, both the hanging or retaining surface, and the projecting member can be spring loaded to be displaced into separate hollow bodies. In another variation, the hub and rib combination can be provided with a pair of mating projecting members and hanging surfaces. In such embodiments, the rib can be supported symmetrically from opposite lateral sides.

Various innovative methods of manufacture also arise from the disclosure herein. In particular, a hub can be assembled using a guide pin and guide recess arrangement. These features quickly and accurately line up holes that receive conventional fasteners. As such assembly of an umbrella hub or a full umbrella assembly can be much more rapid and efficient.

In other innovative methods of manufacturing, assembled hubs can have one or more umbrella structural members hung thereon. Rapid assembly is provided by generally vertically oriented assembly channels that provide for sliding connection between the umbrella structural members and the hubs. Slide-together hub and umbrella structural member connections enable the secure connection of these structures without requiring all the ends of the umbrella structural members to be positioned on a lower hub portion and then to cover the lower hub portion with an upper hub portion, followed by securing the upper and lower portions together by fasteners.

In another embodiment, a method of assembling umbrella components is provided. In the method, an umbrella pole and an umbrella hub are provided. The umbrella pole is disposed within the umbrella hub. An umbrella rib having an inner end is disposed above a slot of the hub. A shaft of the rib end is aligned with a vertical channel of the hub. The shaft is moved relative to the hub from the top surface of the hub toward the bottom surface of the hub. The shaft is secured within the umbrella hub permitting rotation of the umbrella rib while preventing withdrawal of the umbrella rib.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

In accordance with embodiments described herein, there are provided various configurations of a hub and hub assembly that can be used with an umbrella support structure, such as an umbrella or pavilion, to facilitate the rapid and secure fastening of structural ribs with a hub or other structure. As described in greater detail herein, the hub and hub assembly can incorporate various features such that a secure connection with a structure, such as a mounting member of a hub of an umbrella, can be obtained. Additional details and features of related umbrella rib connectors and assemblies are illustrated and described in Applicant's U.S. Pat. No. 7,703,464, issued Apr. 27, 2010, entitled and in Applicant's U.S. Pat. No. 7,891,367, issued Feb. 22, 2011, entitled the entirety of the contents of both of which are incorporated herein by reference.

Figure 1:
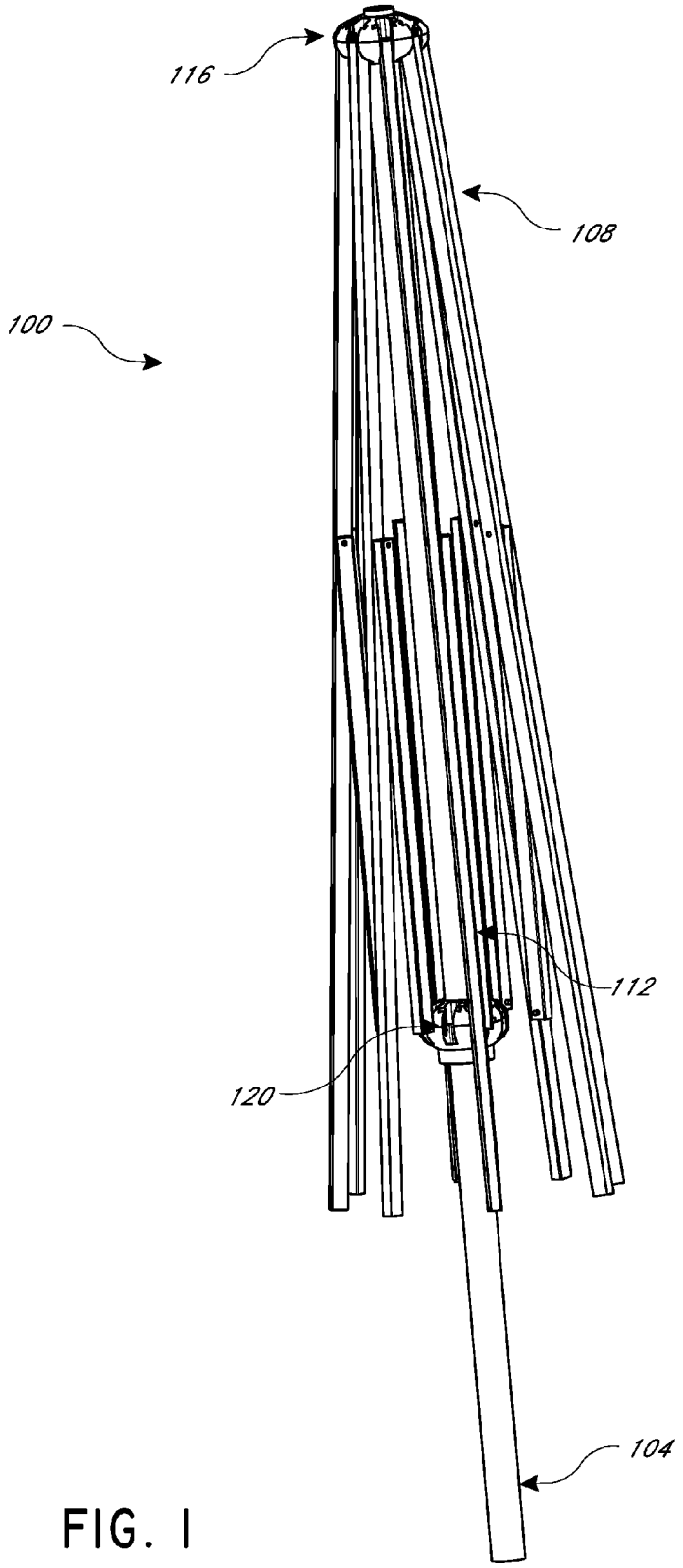
FIG. 1 is a side elevation view of an umbrella assembly including upper and lower hubs and a plurality of umbrella ribs and struts, according to one embodiment.

FIG. 1 shows an umbrella assembly 100 that is large in size, such as for a patio or market space to provide shade to a table or other larger area. The umbrella assembly 100 comprises an umbrella pole 104, a plurality of ribs 108 and a plurality of struts 112. The ribs and struts 108, 112 are sometimes referred to herein collectively as umbrella structural members. The umbrella assembly 100 also includes an upper hub 116 and a lower hub 120. The upper hub 116 can be fixed in elevation and is sometimes referred to as a top notch. The lower hub 120 usually is moveable up and down along the pole and is sometimes referred to as a runner. As discussed more fully below, the ribs and struts 108, 112 interconnect the upper and lower hubs 116, 120 to form a mechanism capable of actuating between open and closed states. The hubs 116, 120 and the umbrella structural members 108, 112 are configured for rapid and efficient assembly, with structures having minimal separate parts and assembly requirements.

The ribs 108 each have a first (outer) end 132 and a second (inner) end 136. The inner end 136 of the ribs 108 is connected to the upper hub 116 and the outer end can be a free end. The ribs 108 are disposed directly below a shade providing structure of an umbrella (typically a fabric cover). The struts 112 each have a first (outer) end 140 and a second (inner) end 144. The outer ends 140 of the struts 112 are connected to the ribs 108 and the inner ends 144 are connected to the lower hub 120. The first end 140 is disposed away from the umbrella pole 104 when the umbrella assembly is in an open configuration and is disposed adjacent to the pole when the umbrella assembly is in a closed configuration. The arrangement of the hubs, struts, and ribs are illustrated in and are clear from FIGS. 1 and 17.

Figure 9:
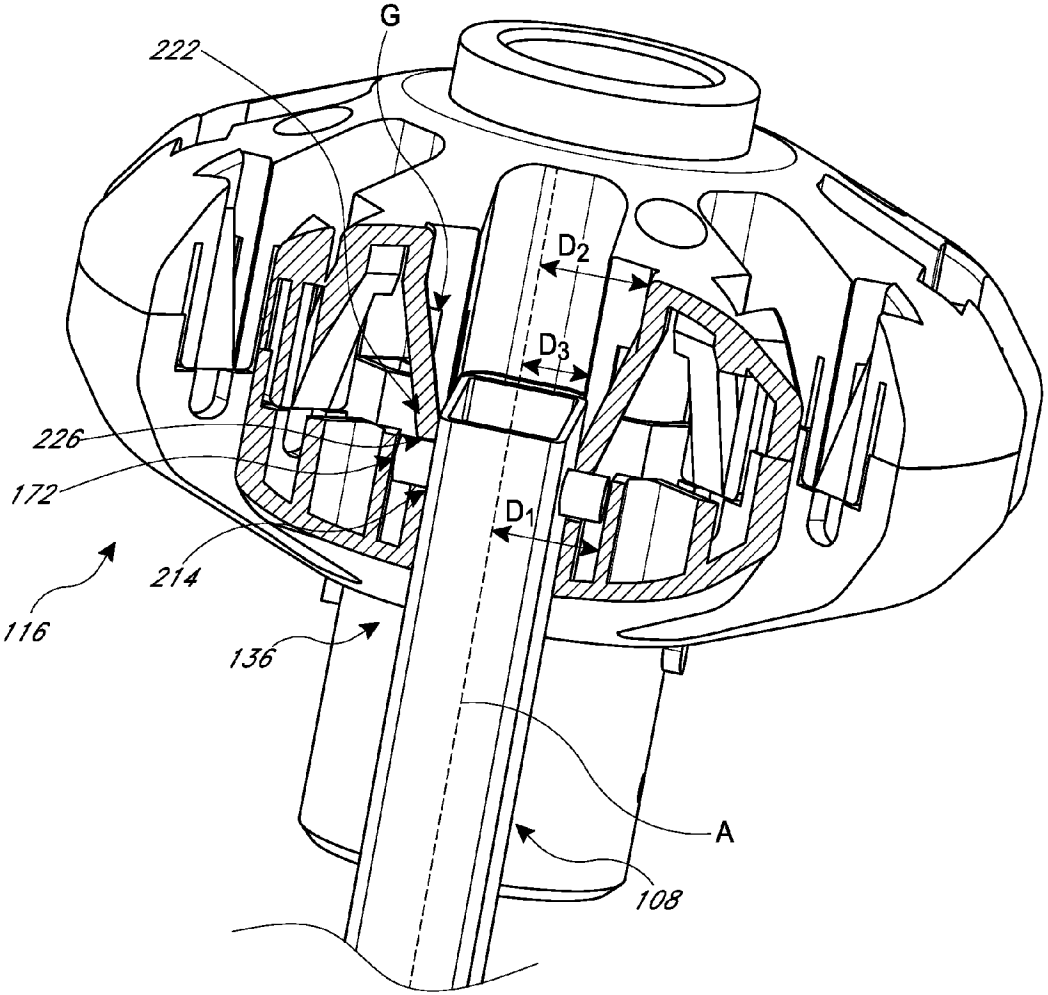
FIG. 9 shows a partial section of the subassembly of FIG. 7 illustrating arrangement of an end of the rib and a portion of the deflectable members.
Figure 10:
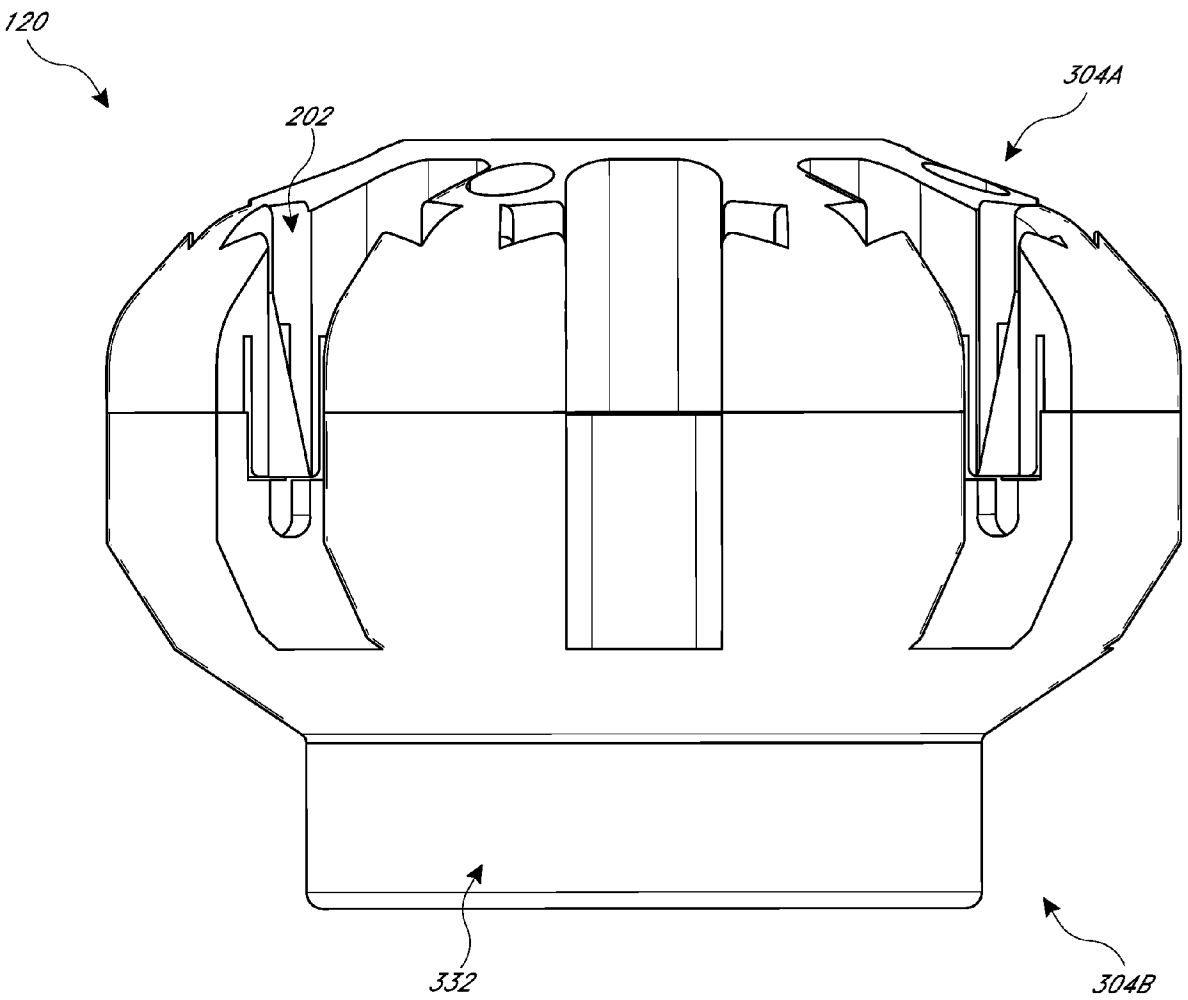
FIG. 10 is a side view of the lower hub illustrated in FIG. 1.
Figure 16:
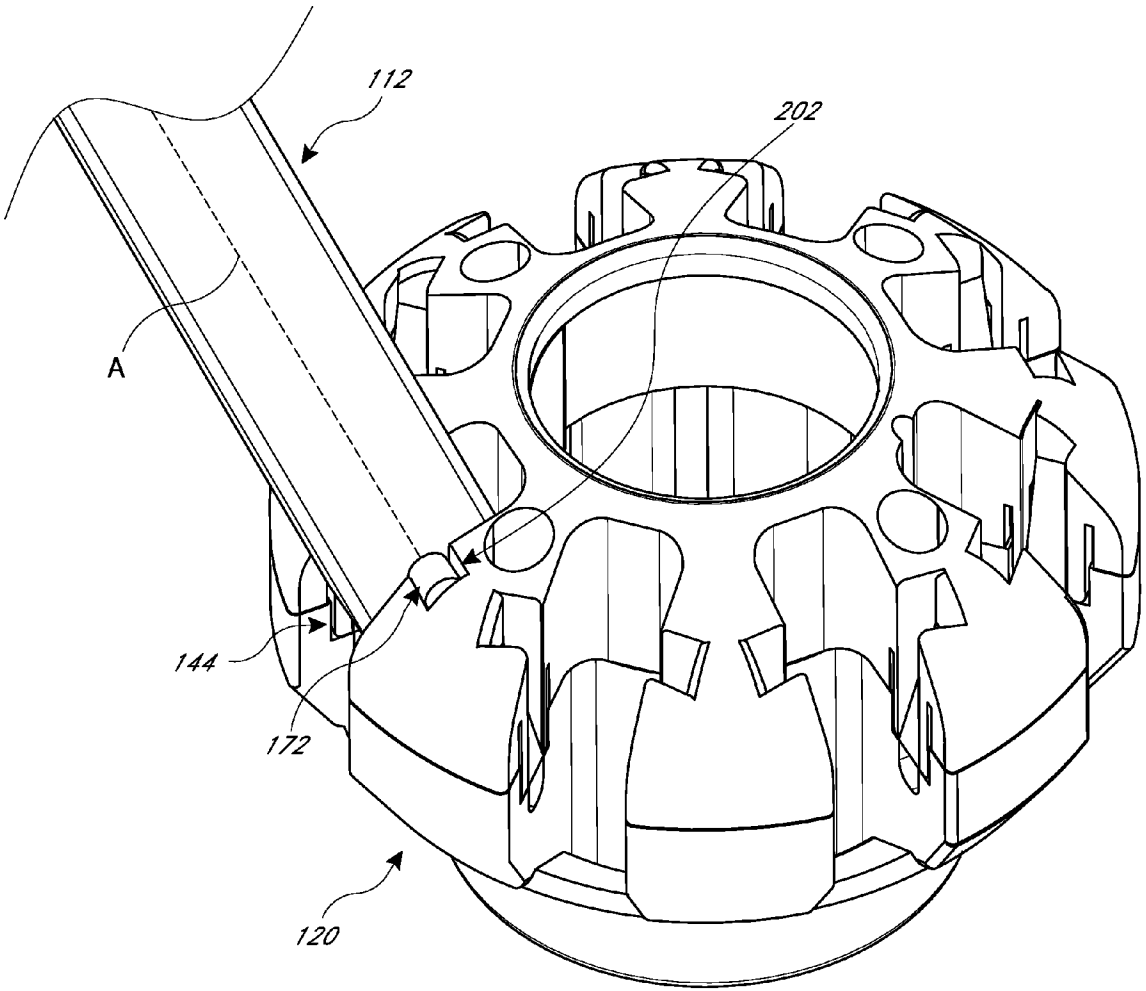
FIG. 16 is a top perspective view of a subassembly including the hub of FIG. 10 and one strut.

The second ends 136, 144 of each of the structural members 108, 112 have a pivoting member 172 that extends transverse to a longitudinal axis A of the umbrella structural member (see FIGS. 9 and 16). The pivoting member 172 enables the umbrella structural members 108, 112 to pivot or swing relative to the hubs 116, 120. The pivoting members 172 also support the ribs and struts 108, 112 in combination with features of the hubs, discussed below.

The upper hub 116 includes a body 178 having a central portion 182 disposed about the umbrella pole 104. The hub 116 also has a top surface 184 and a bottom surface 186 extending between the central portion 182 and an outer periphery 190 of the hub 116. The hub 116 also has an engagement section 194 adjacent to the outer periphery 190, which has the second ends 136 of the ribs 108 disposed therein. The engagement section 194 can include a plurality of rigid projections 194A extending outwardly from the central portion 182. The rigid projections 194A can be separated from each other by spaces 194B. The second ends 132 of the ribs 108 pivot through the movement of the umbrella assembly 100 within the spaces 194B.

In various embodiments, the body 178 is formed by connecting an upper portion 196A including the top surface 184 and a lower portion 196B including the bottom surface 186 together. These portions can be joined at a seam along the outer periphery 190 and can enclose a space that is at least partially hollow. The hollow space has a number of features positioned therein providing unique umbrella functions. As discussed below, such features include alignment and assembly of components as well as mechanisms to retain the second end 132 of the rib 108 within the hub 116.

Figure 5:
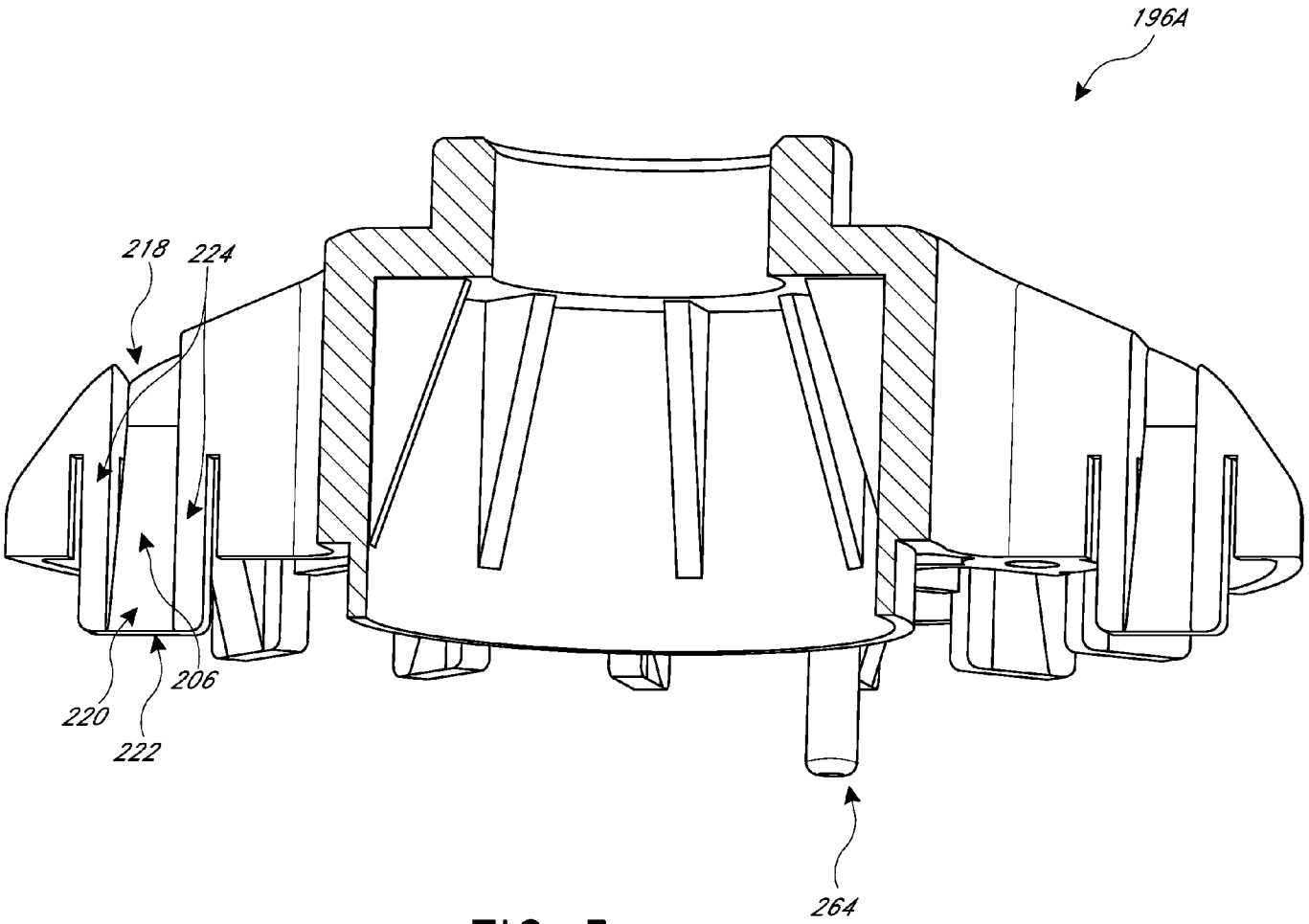
FIG. 5 is a cross-sectional view of the upper portion of the hub of FIG. 3.
Figure 6:
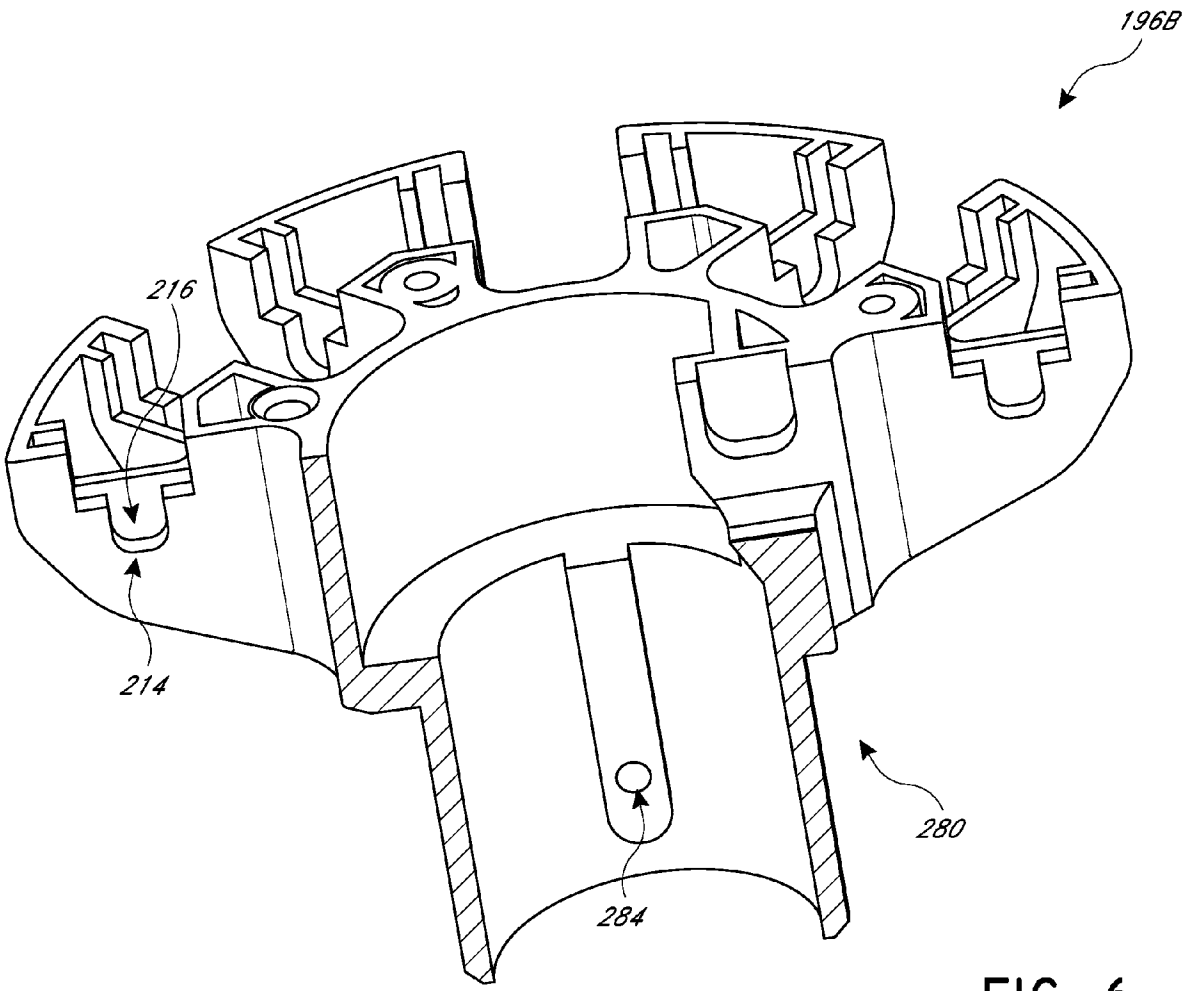
FIG. 6 is a cross-sectional view of the lower portion of the hub of FIG. 3.
Figure 7:
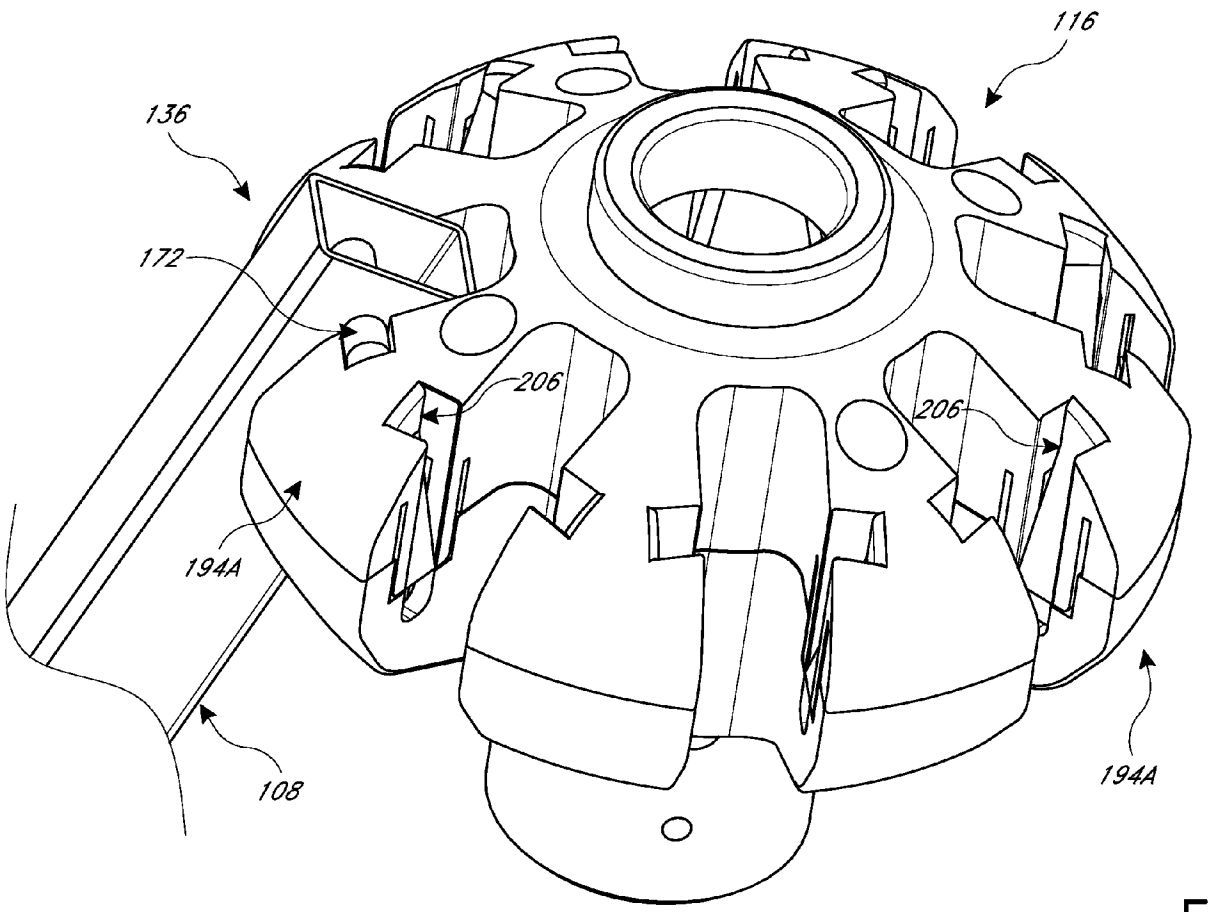
FIG. 7 is a top perspective view of a subassembly including the hub of FIG. 3 and one of the ribs of FIG. 1.

FIGS. 4-9 show that the hub 116 preferably also has a retention mechanism 202 disposed within the engagement section 194. The retention mechanism 202 has a channel 206, a deflectable retention device or deflectable member 210, and a base surface 214. The channel 206 extends from an opening 218 at the top surface 182 toward the bottom surface 186 of the hub 116. FIGS. 5 and 7 show that the channel 206 can be a recess or groove formed in a vertical surface of one, more than one or all of the projections 194A. These figures also show that the channel 206 can have a upper portion closest to the top surface 184 that is configured to freely receive the pivoting member 172 by a sufficient amount such that the pivoting member will not easily be dislodged prior to full assembly. In on arrangement, the retention mechanism 202 is configured such that as the pivoting member 172 is placed into the upper portion of the channel 206, movement of the pivoting member in this direction will not be resisted by the retention mechanism. If the umbrella assembly 100 is assembled in a vertical orientation, the pivoting member 172 can be hung and rested in the upper portion of the channel 206 in a pre-assembled state. FIG. 7 shows that the pivoting member 172 of one of the ribs 108 can rest in the upper portion of the channel 206, e.g. with a least a portion of the member 172 below the top surface 184 of the upper portion 196A prior to full assembly. In some embodiment, the member 172 can rest in a pre-assembled state in the channel 206 with at least about one-half of its cross-section at or beneath the top surface 184.

The deflectable retention device 210 is disposed along the channel 206 beneath the upper portion of the channel. In one embodiment, the deflectable retention device 210 includes an inclined surface 220 that extends from the lower end of the upper portion of the channel toward a free end 222 disposed away from the upper portion of the channel 206 (and from top surface 182 of the body 178). FIG. 9 shows that the free end 222 of the retention device has a cap surface 226. The cap surface 226 rests on top of the pivoting member 172 and prevents the member 172 from moving back up the channel 206 once in the fully assembled state.

The base surface 214 is disposed within the body of the hub 116. The base surface 214 can be a lower portion of a rib or strut hanging notch 216. For example, the lower portion 196B can have a rigid structure such as a rib formed therein with a downwardly disposed notch 216 that is configured to receive the pivoting member 172 therein. As best shown in FIG. 9, the pivoting member 172 is retained between the base surface 214 and the cap surface 226.

Figure 8:
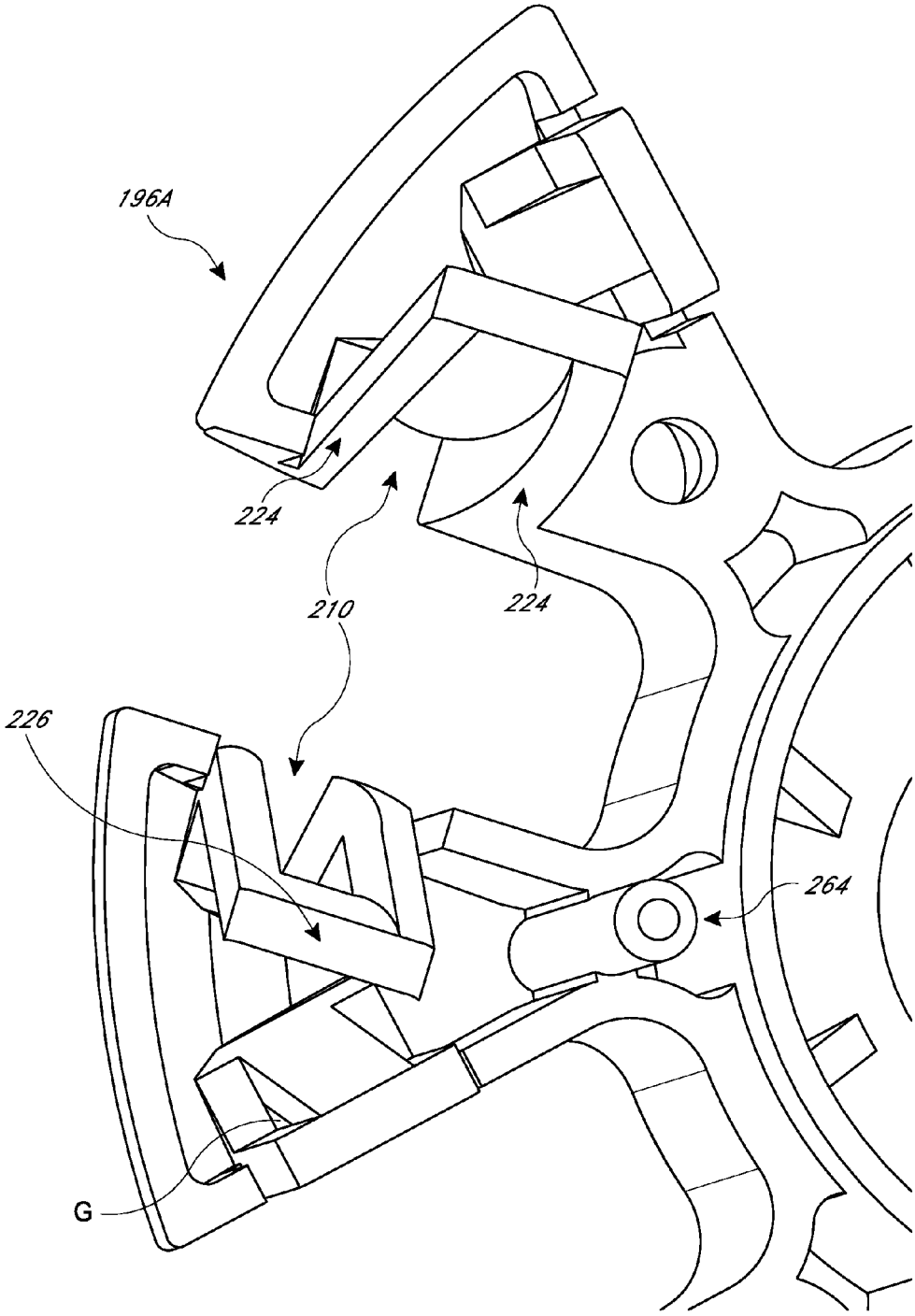
FIG. 8 is a detail view of one embodiment of a retention mechanism, including a plurality of deflectable members disposed in a generally vertical channel.

In another aspect, the engagement section 194 comprises the projections 194A separated by the spaces 194B. Inner ends of the umbrella structural members swing within the spaces 194B as discussed above. A central plane bisects each of the spaces 194B. The pivoting member 172 extends a first distance $D_1$ from a central plane that corresponds to the longitudinal axis A (see FIG. 9). An upper portion of the deflectable retention device 210 is disposed a second distance $D_2$ greater than the first distance $D_1$ from the central plane. A lower portion of the deflectable retention device disposed a third distance $D_3$ less than the first distance $D_1$ from the central plane. This construction provides that the pivoting member 172 can easily be placed in position in the area having the dimension $D_2$ in a pre-assembled state with little or no force by the assembler. Thereafter, a downward force can be applied to press the deflectable retention device 210 away from the central plane of the space 194B. This can cause the free end 222 to move to a position that is greater than $D_3$ from the central plane of the space 194B. After the pivoting member is disposed beneath the free end 222, the deflectable retention device 210 moves back to the position shown in FIG. 9. In the illustrated embodiment, the movement back to the position of FIG. 9 can be by release of stored strain energy, where the deflectable retention device 210 has an elastic configuration. Strain energy is stored in the deflectable retention device 210 as it is deflected away from the axis A. Full strain configuration of two adjacent and paired deflectable retention devices 210 is shown in FIG. 8. The devices 210 are on opposite sides of one of the spaces 194B and are simultaneously deflected by pivoting members 172.

The hubs disclosed herein are advantageous in providing unique combinations of quick assemble capability with a robust, strong design. For example, FIG. 9 shows that the weight of the ribs 108 when disposed downwardly (e.g., closed position of the umbrella) is supported by the surface 214 in the lower portion 196B. The surface 214 and the lower portion around it are fixed structure and will not be subject to wear from repeated deflections. Nor are they formed or projecting from any thin lands of material that would focus stress and be likely to break well before a duty cycle based on normal usage. FIGS. 5 and 8 show that the inclined surface 220 is supported not only from its attachment to the vertical portion of the opening 218 but also by one or more braces 224 that connect the structure forming the cap surface 226 to the upper portion 196A. In one embodiment, the brace(s) 224 comprise a first end disposed closer to the top surface 184 and a second end coupled with the free end 222. The braces 224 can be disposed on an inner side of the deflectable retention device 210, e.g. between the device 210 and the central portion 182. The braces 224 can be disposed on an outer side of the deflectable retention device 210, e.g. between the device 210 and the outer periphery 190. The braces 224 can be disposed on both an outer side and an inner side of the deflectable retention device 210. The braces 224 can be generally vertically oriented, e.g., on a projection of the surfaces of the projections 194A facing the spaces 194B. Gaps G can be formed between the braces 224 and the deflectable retention device 210 to provide a balance between flexibility and bracing. The inclined surface 220 is thus reinforced with multiple structures that enables it to provide sufficient retention force to the installed ribs 108 in the event of any upward force during operation. Thus, the surfaces 214, 226 and the other structure of the hub 116 provide a very robust construction. Analogous features may be found in the runner or lower hub 120 and these descriptions are equally applicable to the runner or lower hub.

Figure 2:
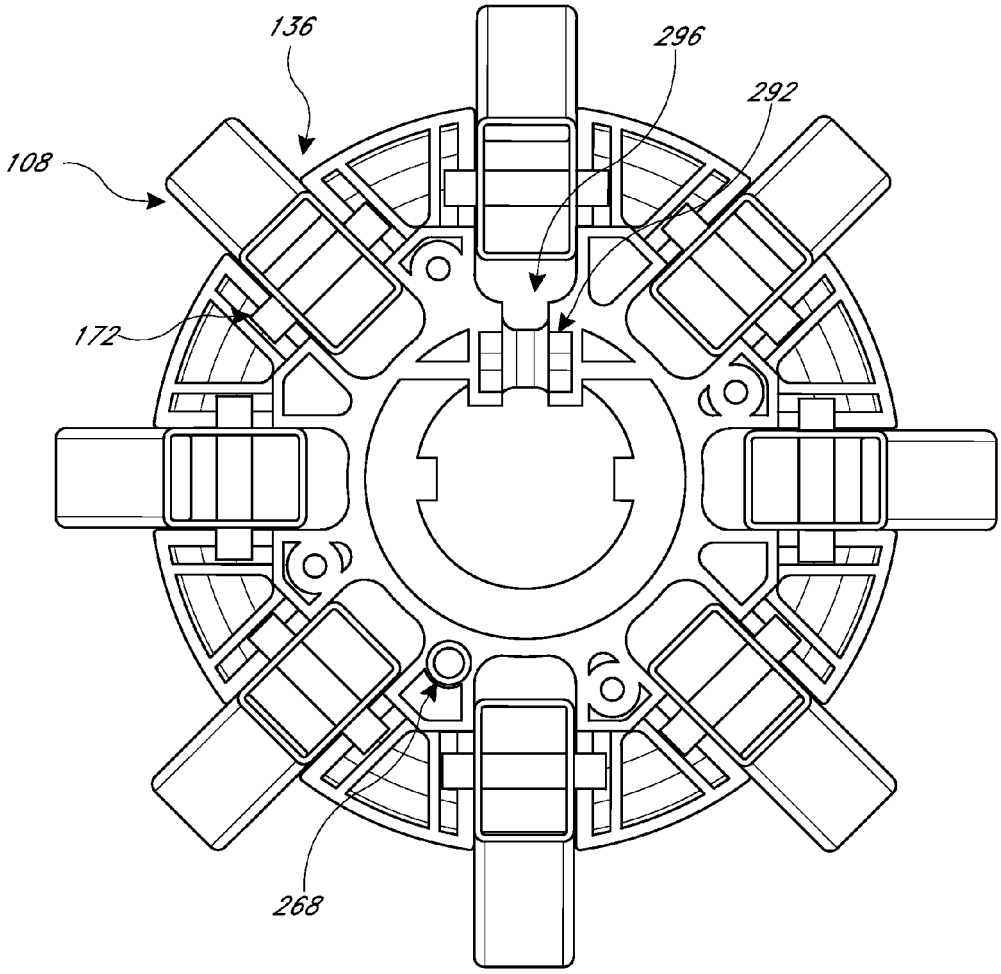
FIG. 2 is a top view of a hub and rib assembly with an upper portion of the hub removed such that inner ends of the ribs and a lower portion of the hub shown.
Figure 4:
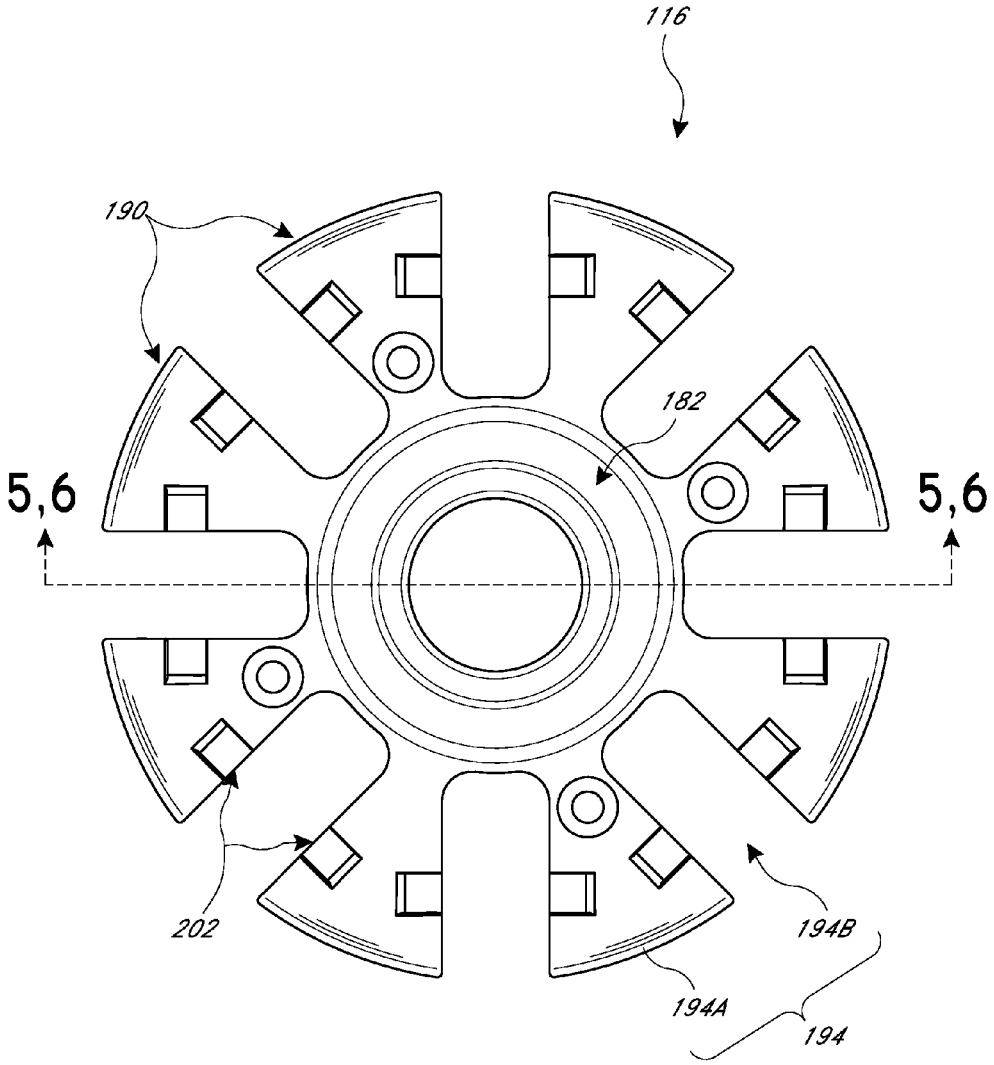
FIG. 4 is a top view of an upper portion of the hub shown in FIG. 3.

Various features can be provided on the hub 116 to make it More convenient for assembly and use. For example, where the hub 116 is formed as a plurality of portions to be assembled, an alignment device can be provided to aid in assembling the hub. In one embodiment, a guide pin 264 is provided on the upper portion 196A and a guide recess 268 is provided on the lower portion 196B of the hub 116. The guide pin 264 and guide recess 268 guide the upper and lower portions 196A, 196B into alignment during assembly of the hub 116. In some embodiments, a hub-structural member assembly could be formed by placing at least some of the structural member within the lower portion of a hub as shown in FIG. 2. Then an upper portion of the hub could be applied to the lower portion with the use of the guide pins and guide recess 264, 268. Thereafter screw can be anchored through holes in the upper portion (shown in FIG. 4) into holes the lower portion (shown in FIG. 2). In these embodiments, the free ends of retention devices on the upper portion of the hub still cooperate with the lower portion of the hub but deflection of the retention free ends of the retention devices is not required in order to place the umbrella structural members.

Figure 3:
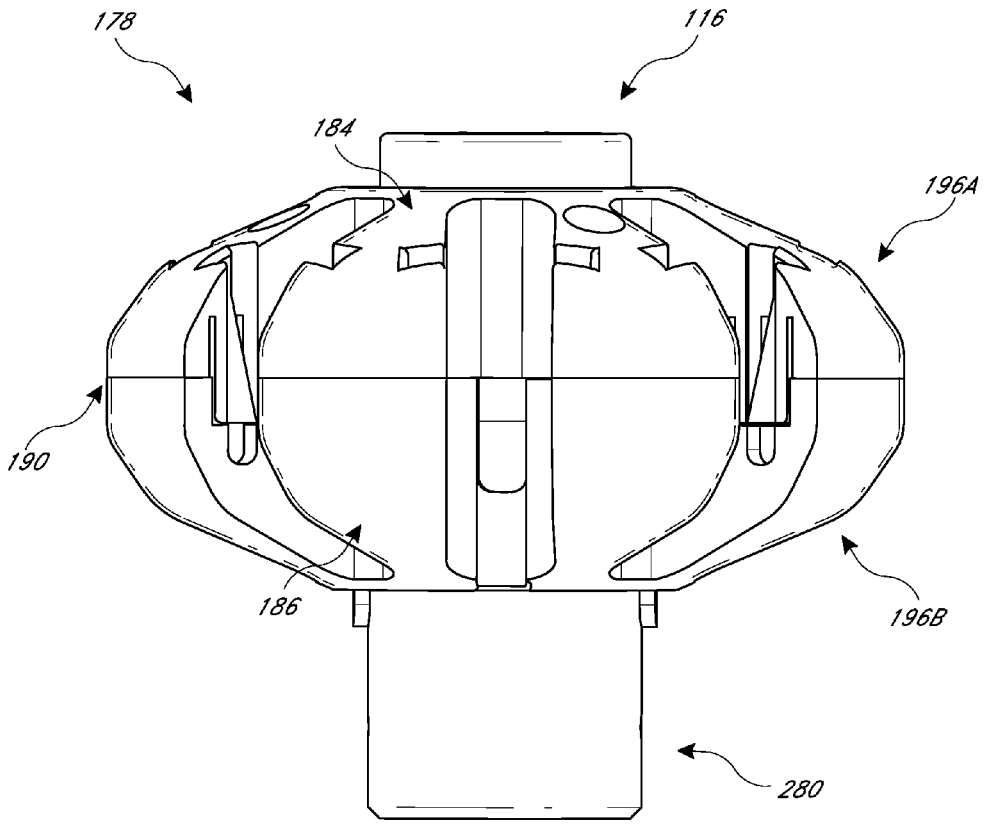
FIG. 3 is a side elevation view of the upper hub illustrated in FIG. 1.

FIGS. 3 and 6 shows that the hub 116 can have a downwardly disposed collar 280 configured to engage the umbrella pole 104 in a secure manner. For example, the pole 104 can have an inner diameter that is larger than the outer diameter of the collar 280 such that collar 280 is received within the pole 104. A flange 284 can be provided to receive a screw or other fastener that can be advanced through the umbrella pole 104 to provide robust and rigid connection between the pole and the hub 116. This arrangement is convenient for top notch configuration, e.g., where the hub 116 is an upper hub that is not movable relative to the pole.

If the umbrella works by providing a cord to raise the lower hub 120, the upper hub 116 can be provided with a pulley mount 292 and a cord channel 296 along a surface of the hub 116. These features facilitate easy operation of assembled umbrella 100 and long lasting use.

FIGS. 10-16 show that the lower hub 120, which can be a runner, is formed in a manner similar to that of the upper hub 116. Thus, the description of the lower hub 120 will not describe all the same features again. Rather, the general structures will be discussed and differences form the upper hub will be a focus. However, all the analogous features of the hub 116 are incorporated into and are part of the lower hub 120 as is apparent from the figures.

The hub 120 can be provided with upper and lower portions 304A, 304B. The upper portion 304A has a part of a retention mechanism 202 therein. The retention mechanism 202 can be the same as discussed above, and can be used to secure the struts 112 therein, as shown in FIG. 16.

Figure 11:
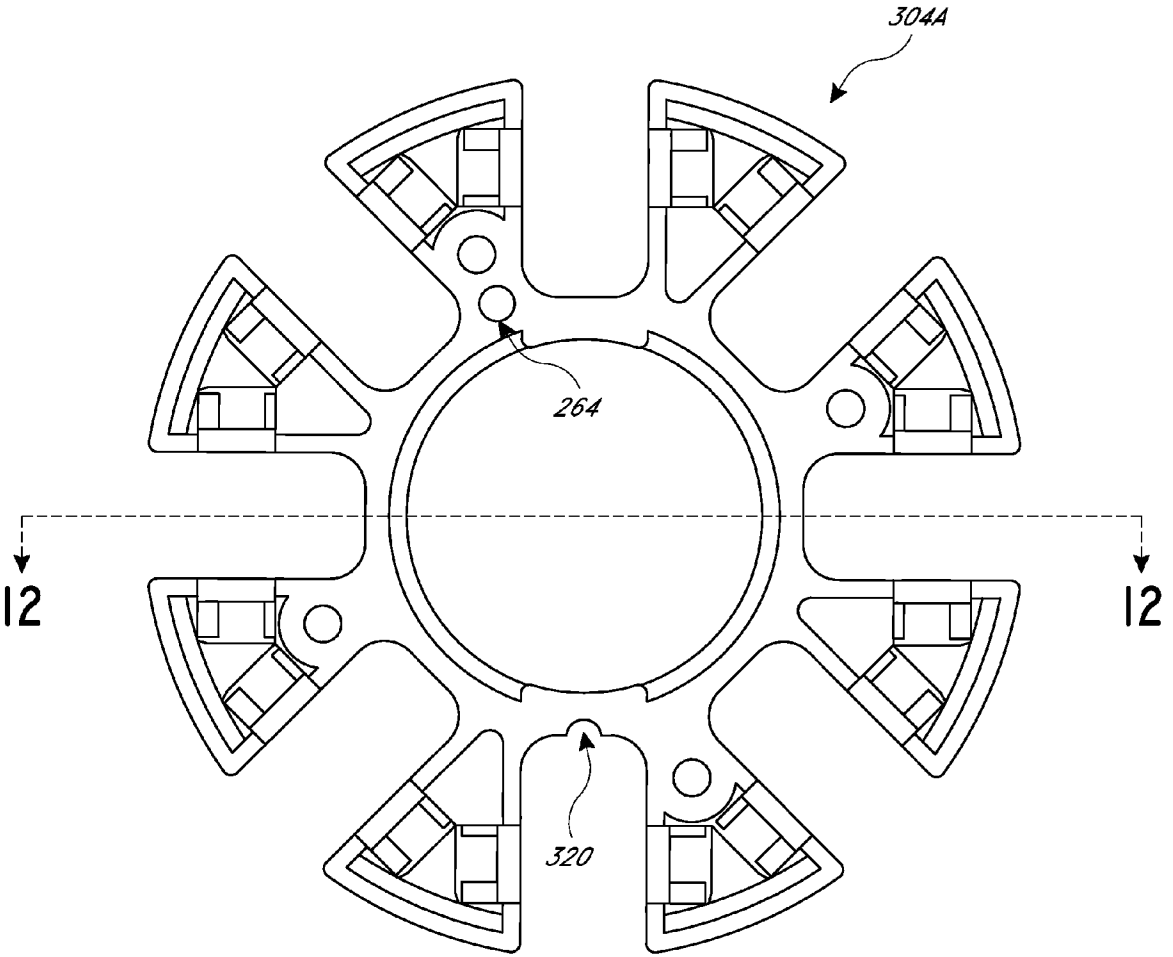
FIG. 11 is a view of a bottom side of an upper portion of the lower hub shown in FIG. 10.
Figure 12:
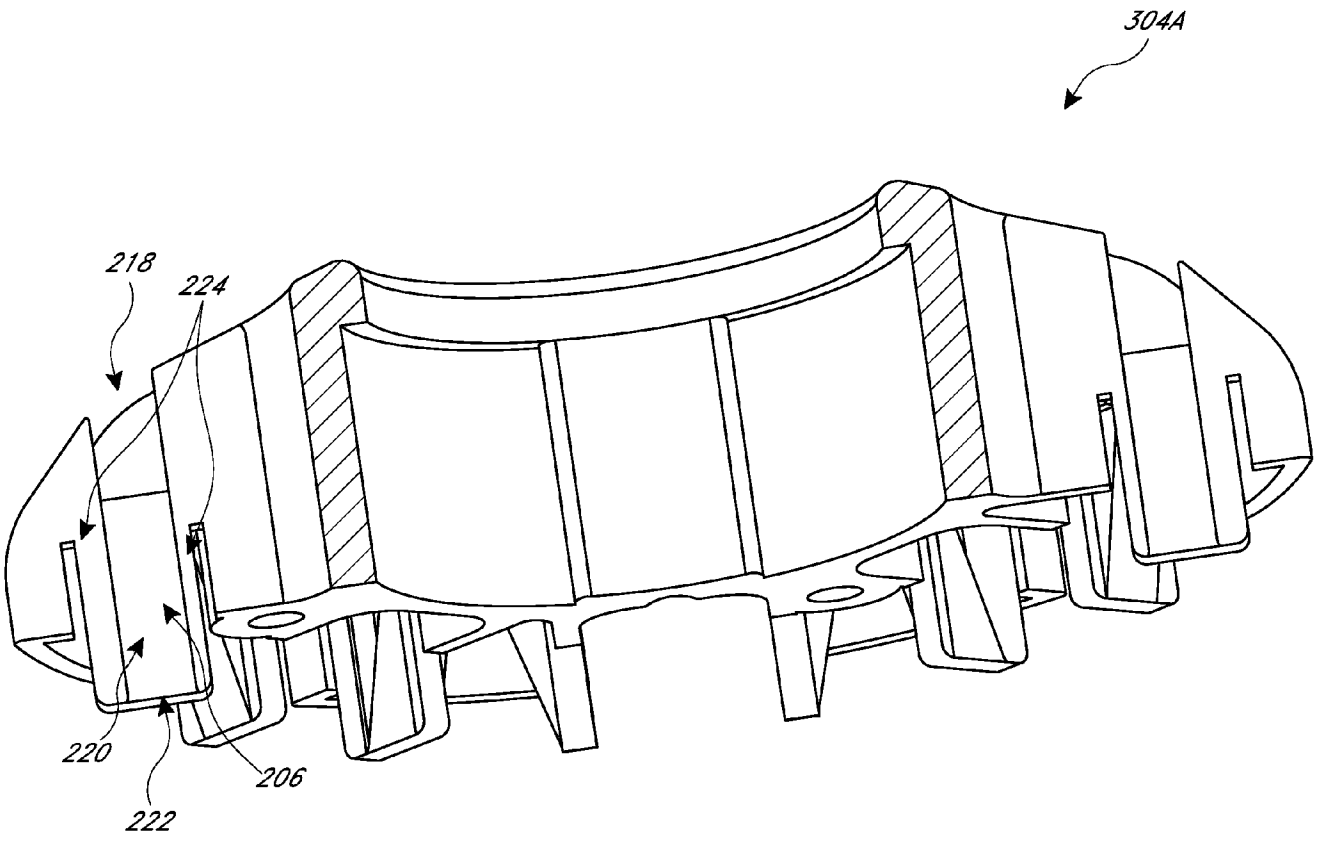
FIG. 12 is a cross-sectional view of the upper portion of the hub of FIG. 10.
Figure 13:
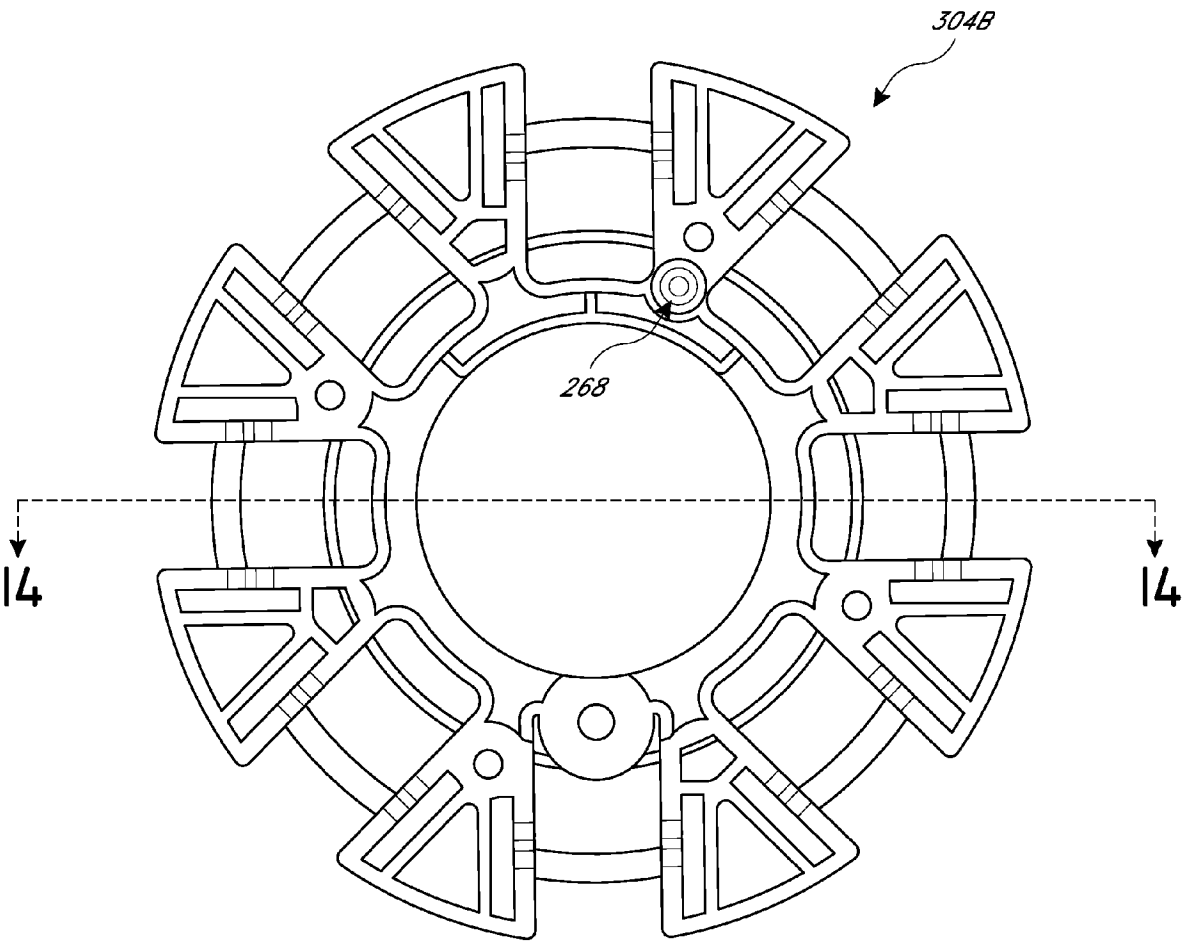
FIG. 13 is a view of a top side of the lower portion of the lower hub shown in FIG. 10.
Figure 14:
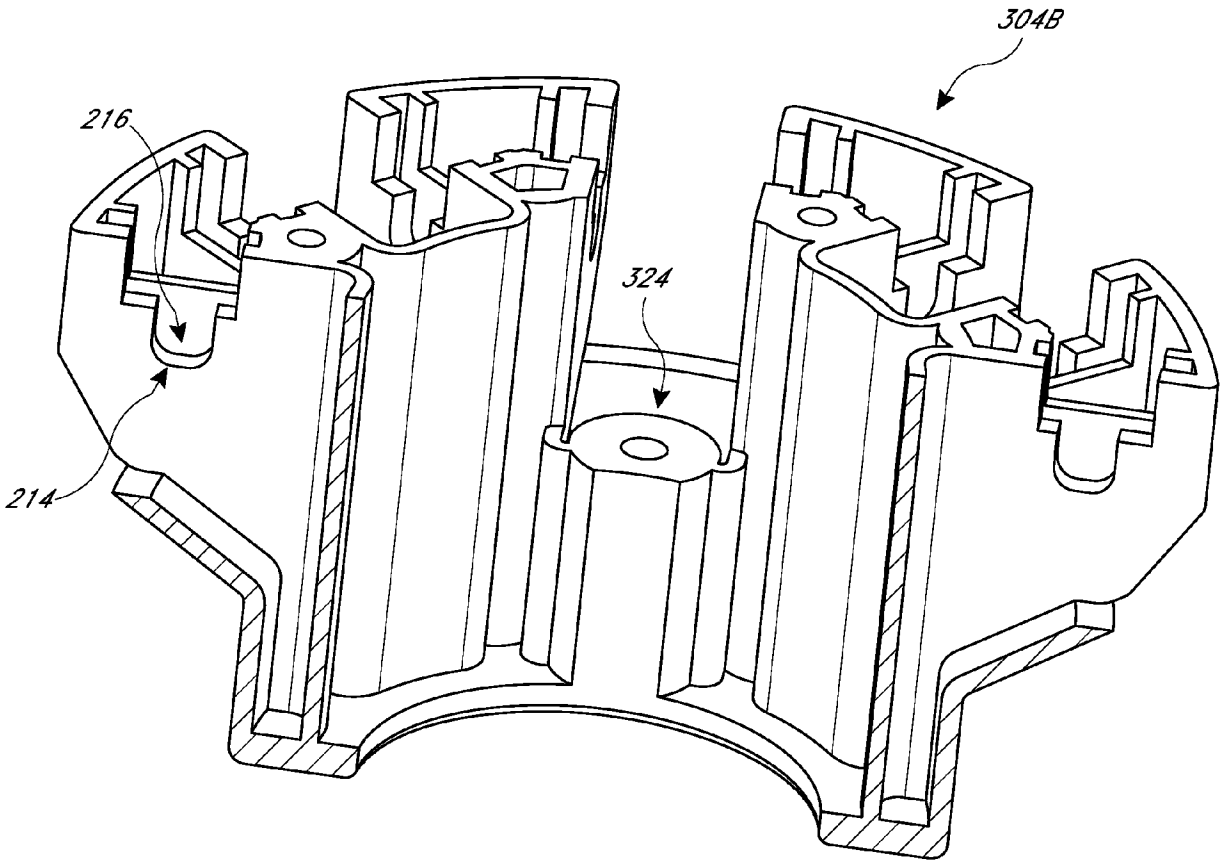
FIG. 14 is a cross-sectional view of the lower portion of the hub of FIG. 10.
Figure 15:
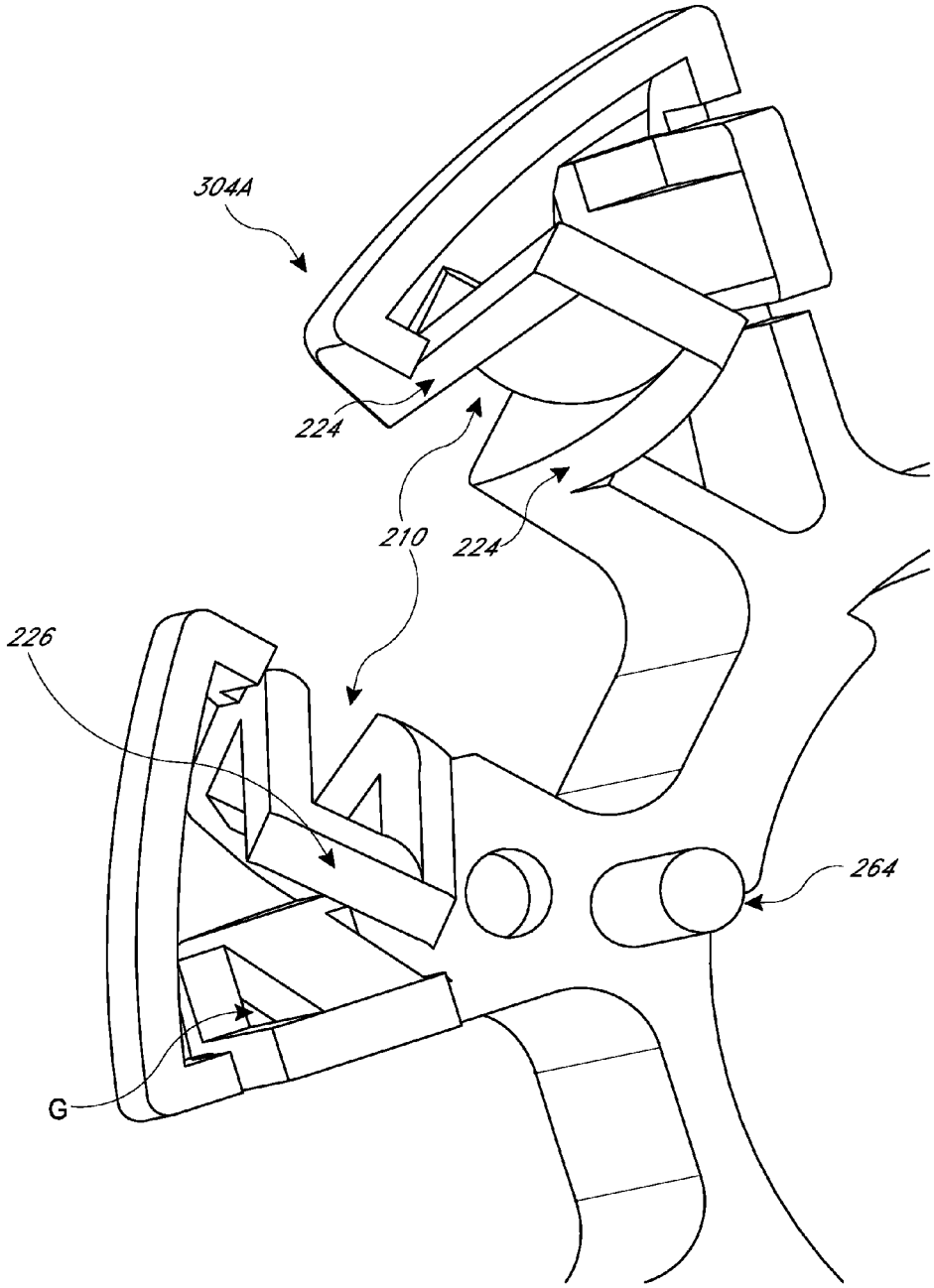
FIG. 15 is a detail view of one embodiment of a retention mechanism, similar to that of FIG. 8, including a plurality of deflectable members disposed in a generally vertical channel.

FIGS. 11 and 14 show the cord passage through the hub 120. In particular, the upper portion 304A has a channel 320 formed in one the spaces in which the struts 112 are received. The channel 320 can be an open channel such that only a portion of a cord may be disposed in or slide along the channel 320. The lower portion 304B of the hub 120 can also have a channel 324 through which the cord may be disposed in or slide.

The lower portion 304B of the hub 120 can be provided with a collar 332 that is axially shorter than the collar 280. The collar 332 facilitates sliding motion of the hub 120 along the pole 104.

Figure 17:
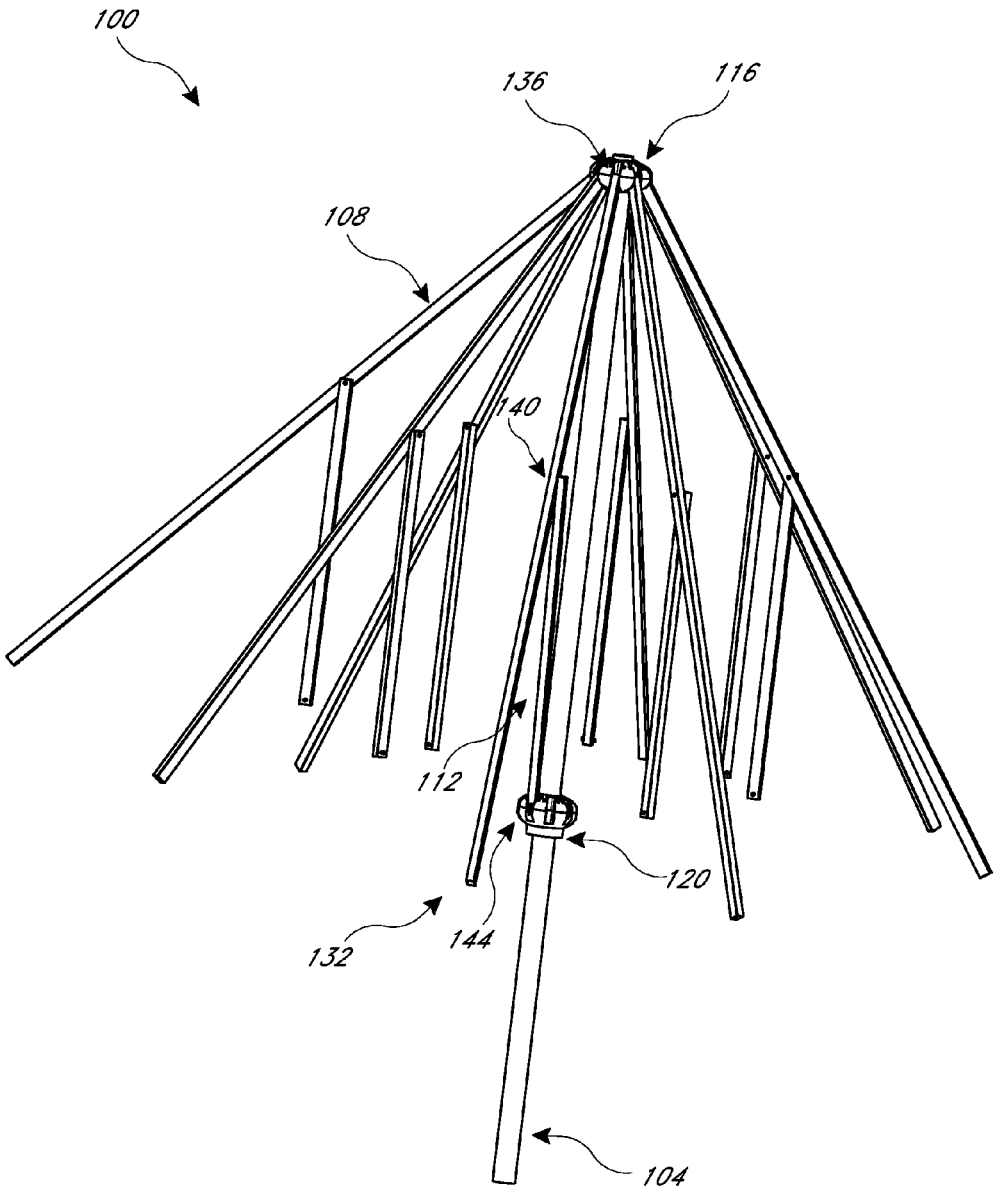
FIG. 17 is a subassembly of an umbrella, where one of a plurality of struts is coupled with the lower hub of FIG. 10 and where the other struts are not so connected.

A method of manufacturing is provided by the arrangements described above. In particular, the hubs 116, 120 can be assembled using the guide pins and recesses 264, 268 discussed above. The hubs 116, 120 are fastened together in a suitable manner thereafter. Next, the hub 116 can be coupled with the pole 104 as discussed above, for example, having the collar 280 received in the pole 104. The hub 120 can be disposed about the pole 104 beneath the hub 108. Thereafter, the pivoting members 172, which can be pins, of each rib 108 are into the retention mechanism 202. For example, the pivoting members 172 can be lowered into the channels 206 to come into rest just above the deflectable members 210. After placing each of the ribs 108, a downward force can be applied to slide the pivoting member 172 down along the deflectable members 210 and into position in the notches 216 on base surface 214. FIG. 17 shows in one technique, all the ribs 108 are put into the fully assembled position, with the pivoting members 172 in the notches 216. Thereafter, the struts 112 are placed one-by-one into the retention mechanisms 202 of the lower hub 120. As in the upper hub, the pivoting members 172 of the struts 112 are lowered into the channels 206 to come into rest just above the deflectable members 210. Either the weight of the ribs 108, an operator generated downward force or a combination of these causes the pivoting members 172 to deflect the members 210 and to move into position in the notches 216 on base surface 214.

In some embodiments, the hub can be configured to include additional parts other than two halves. Such additional parts may serve to increase the functionality or otherwise enhance the physical characteristics of the hub. For example, any of the hubs can include cord locking device that facilitates holding a hub in a selected elevated position, such as are described in U.S. Pat. No. 8,356,613, which is incorporated by reference herein in its entirety.

The hub assembly can comprise a hub and an end of an umbrella rib. The hub of the assembly can be configured in any of the ways or combinations of the ways described herein to ensure that the umbrella rib is quickly and securely attached thereto while permitting relative rotational movement of the rib. Accordingly, the rib can be configured to include an interconnective geometry on a distal end thereof such that the distal end of the rib can be interconnected with the hub. The interconnection may allow for selective disengagement of the connection or may result in permanent connectivity.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An umbrella assembly comprising:

an umbrella pole;

an umbrella structural member having a first end and a second end, the first end to be disposed away from the umbrella pole when the umbrella assembly is in an open configuration, the second end of the umbrella structural member having a pivoting member extending transverse to a longitudinal axis of the umbrella structural member;

a hub comprising:

a body having a central portion disposed about the umbrella pole, a top surface and a bottom surface extending between the central portion and an outer periphery of the hub, an engagement section adjacent to the outer periphery, the engagement section having the second end of the umbrella structural member disposed therein; and a retention mechanism disposed within the engagement section, the retention mechanism comprising:

a channel extending from an opening at the top surface toward the bottom surface;

a deflectable retention device disposed along the channel, the retention device having a free end disposed away from the top surface of the body, the free end having a cap surface; and a base surface disposed within the body of the hub;

wherein the pivoting member is retained between the base surface and the cap surface, wherein the deflectable retention device comprises an inclined surface disposed on a side of the engagement section.

2. The umbrella assembly of claim 1, wherein the deflectable retention device comprises an inclined surface disposed on each side of the engagement section.

3. The umbrella assembly of claim 1, wherein the hub is an upper hub and further comprising a runner comprising a strut receiving channel extending from an opening on a top surface of the runner, the strut receiving channel having a deflectable member device disposed therein, the free end of the deflectable member comprising the cap surface.

4. An umbrella assembly comprising:

an umbrella pole;

an umbrella structural member having a first end and a second end, the first end to be disposed away from the umbrella pole when the umbrella assembly is in an open configuration, the second end of the umbrella structural member having a pivoting member extending transverse to a longitudinal axis of the umbrella structural member;

a hub comprising:

a body having a central portion disposed about the umbrella pole, a top surface and a bottom surface extending between the central portion and an outer periphery of the hub, an engagement section adjacent to the outer periphery, the engagement section having the second end of the umbrella structural member disposed therein; and a retention mechanism disposed within the engagement section, the retention mechanism comprising:

a channel extending from an opening at the top surface toward the bottom surface;

a deflectable retention device disposed along the channel, the retention device having a free end disposed away from the top surface of the body, the free end having a cap surface; and a base surface disposed within the body of the hub;

wherein the pivoting member is retained between the base surface and the cap surface, wherein the engagement section comprises projections separated by spaces within which inner ends of the umbrella structural members swings, a central plane bisecting each of the spaces, and wherein the pivoting member extends a first distance from the central plane, an upper portion of the deflectable retention device is disposed a second distance greater than the first distance from the central plane and a lower portion of the deflectable retention device disposed a third distance less than the first distance from the central plane.

5. The umbrella assembly comprising:

an umbrella pole;

an umbrella structural member having a first end and a second end, the first end to be disposed away from the umbrella pole when the umbrella assembly is in an open configuration, the second end of the umbrella structural member having a pivoting member extending transverse to a longitudinal axis of the umbrella structural member;

a hub comprising:

a body having a central portion disposed about the umbrella pole, a top surface and a bottom surface extending between the central portion and an outer periphery of the hub, an engagement section adjacent to the outer periphery, the engagement section having the second end of the umbrella structural member disposed therein; and a retention mechanism disposed within the engagement section, the retention mechanism comprising:

a channel extending from an opening at the top surface toward the bottom surface;

a deflectable retention device disposed along the channel, the retention device having a free end disposed away from the top surface of the body, the free end having a cap surface; and a base surface disposed within the body of the hub;

wherein the pivoting member is retained between the base surface and the cap surface, wherein the retention mechanism further comprises at least one brace extending from the body to the free end of the deflectable retention device.

6. A quick connect system for a shade structure comprising:

a hub having a top surface, a plurality of side walls forming a slot therebetween, and a displaceable retention device having a free end disposed at an elevation below the top surface and moveable laterally away from the slot;

a structural member having an end configured to swing in the slot, the end having a laterally extending rotation device;

wherein the rotation device extends laterally beyond the free end of the displaceable retention device when the end is disposed in the slot; and a brace extending from one of the sidewalls of the hub to the free end of the displaceable retention device.

7. The quick connect system of claim 6, wherein the displaceable retention device comprises a fixed end opposite the free end and the free end has a first position during insertion of the structural member into the slot and a second position when the structural member is fully inserted into the slot, the first position being laterally outside of the second position.

8. The quick connect system of claim 7, wherein the fixed end being disposed laterally between the first position and the second position.

9. The quick connect system of claim 7, wherein the fixed end is recessed into one of the side walls and the fixed end of the displaceable member is disposed laterally beyond the rotation device.

10. The quick connect system of claim 6, wherein the hub comprises a plurality of displaceable retention devices disposed on opposite sides of the slot and the structural member comprises the laterally extending rotation device disposed on each lateral side of the structural member, each displaceable retention device configured to retain a corresponding rotation device of the structural member.

11. The quick connect system of claim 6, wherein the hub comprises a fixed rotation support disposed in the hub to support rotation of the structural member from below.

12. The quick connect system of claim 6, wherein the hub comprises an upper portion and a lower portion, one of the upper and lower portions having a guide pin, the other of the upper and lower portions having a guide recess, the guide pin and guide recess guiding the upper and lower portions into alignment.

13. The quick connect system of claim 6, wherein the hub comprises a central aperture configured to receive an elongate support member.

14. The quick connect system of claim 13, wherein the elongate support member comprises an umbrella pole.

15. The quick connect system of claim 13, wherein the hub comprises an aperture for receiving a cord for remotely guiding the hub along the elongate support member.

16. The quick connect system of claim 13, wherein the hub comprises a flange for securing the hub to the elongate support member.

17. The quick connect system of claim 6, wherein the hub comprises a channel for guiding a cord.

18. An umbrella hub comprising:

a central portion configured to receive to an umbrella pole;

a body having a top surface and a bottom surface extending between the central portion and an outer periphery of the hub, an outer portion adjacent to the outer periphery configured to receive an end portion of an umbrella structural member; and a retention mechanism disposed within the outer portion of the body, the retention mechanism comprising:

a channel extending from an opening at the top surface toward the bottom surface;

a moveable retention device disposed between the opening and the bottom surface;

wherein, in a first configuration the moveable retention device permits an umbrella structural member to be moved from the opening to a retained position and in a second configuration the moveable retention device prevents the umbrella structural member from being withdrawn from the retention mechanism;

wherein the movable retention device comprises a fixed end, and a free end, and an elongated surface disposed there between, the free end being disposed between the fixed end and the bottom surface, pivoting of the elongate member enabling at least the free end to move between the first and second configurations.

19. The umbrella hub of claim 18, wherein the body comprises an umbrella pole channel extending along a longitudinal axis, the channel of the retention mechanism extending substantially parallel to the umbrella pole channel.

20. The umbrella hub of claim 18, wherein the hub further comprises a base surface disposed within the body of the hub, the retention device comprises a cap surface, the base surface and cap surface defining a retention space for holding a pivotable member of a rib.

21. A method of assembling umbrella components, comprising:

aligning an inner end of an umbrella rib with a slot of an umbrella hub, the umbrella rib having a pivoting member disposed through the inner end thereof, the pivoting member extending along a longitudinal axis;

moving the pivoting member of the umbrella rib relative to the umbrella hub along an inclined surface disposed on a side of the slot from a top surface of the hub toward a bottom surface of the hub, the pivoting member deflecting the inclined surface in a direction along the longitudinal axis of the pivoting member; and securing the inner end of the umbrella rib within the umbrella hub permitting rotation of the umbrella rib while preventing withdrawal of the umbrella rib.

22. The method of claim 21, further comprising actuating a retention device from a securing configuration to an assembly configuration prior to securing the shaft.

23. The method of claim 22, wherein the actuating and moving steps are performed simultaneously.

24. The method of claim 21, wherein the umbrella hub comprises a top surface and the inclined surface comprises a free end disposed away from the top surface of the body, the free end having a cap surface.

* * * * *

UNITED STATES PATENT AND TRADEMARK OFFICE

CERTIFICATE OF CORRECTION

PATENT NO. : 9,192,215 B2
APPLICATION NO. : 13/783958
DATED : November 24, 2015
INVENTOR(S) : Ma It is certified that error appears in the above-identified patent and that said Letters Patent is hereby corrected as shown below:

On the title page 2, item [56], column 2, at lines 40-41, change "European European" to --European--.

In the specification

Column 5 line 63, Change "on" to --an--.

Column 7 line 29, Change "More" to --more--.

In the claims

Column 10 line 32, Claim 5, change "The" to --An--.

Column 12 line 16, Claim 18, change "and a" to --a--.

Column 12 line 16, Claim 18, change "elongated" to --elongate--.

Signed and Sealed this
Twenty-sixth Day of July, 2016

Michelle K. Lee

Michelle K. Lee
*Director of the United States Patent and Trademark Office*